United States Patent [19]

Voorheis

[11] 4,395,957

[45] Aug. 2, 1983

[54] TANGENT SPIN FURNACE

[75] Inventor: James T. Voorheis, Essex Fells, N.J.

[73] Assignee: Voorheis Industries, Inc., Fairfield, N.J.

[21] Appl. No.: 258,885

[22] Filed: Apr. 30, 1981

[51] Int. Cl.[3] ..... F23G 5/12

[52] U.S. Cl. ..... 110/244; 432/176; 110/251

[58] Field of Search ..... 110/243, 244, 251, 235, 110/261, 263; 98/40 V, 40 VM, 40 B; 423/176

[56] References Cited

U.S. PATENT DOCUMENTS

| | | | |
|---|---|---|---|
| 3,396,681 | 8/1968 | Hubbard | 110/244 |
| 3,536,018 | 10/1970 | Phelps | 110/244 |
| 3,658,017 | 4/1972 | Dibelius et al. | 110/244 |
| 3,777,678 | 12/1973 | Lutes et al. | 110/244 |
| 3,817,192 | 6/1974 | Watterback | 110/244 |
| 4,094,631 | 6/1978 | Grieve | 432/176 |
| 4,276,818 | 7/1981 | Makara et al. | 98/40 B |

FOREIGN PATENT DOCUMENTS

| | | | |
|---|---|---|---|
| 485444 | 7/1977 | Australia | 110/244 |
| 1506760 | 4/1978 | United Kingdom | 110/244 |

*Primary Examiner*—Henry C. Yuen

*Attorney, Agent, or Firm*—David A. Jackson

[57] ABSTRACT

A tangent spin furnace providing a combustion chamber of metal which is unlined with any refractory material but whose temperature is maintained below the self-destruct level by combustion air being introduced into the combustion chamber between a plurality of slats defining the combustion chamber and disposed in spaced relation to each other so that they define longitudinal slots. Thus there are slots for the introduction of combustion air between the slats so that a sweep of combustion air is maintained peripherally inside of the combustion chamber over virtually the entire inner surface thereof. Without refractory material lining the combustion chamber overheating is avoided by the cooling effect of the sweep of combustion air.

4 Claims, 3 Drawing Figures

FIG. 1
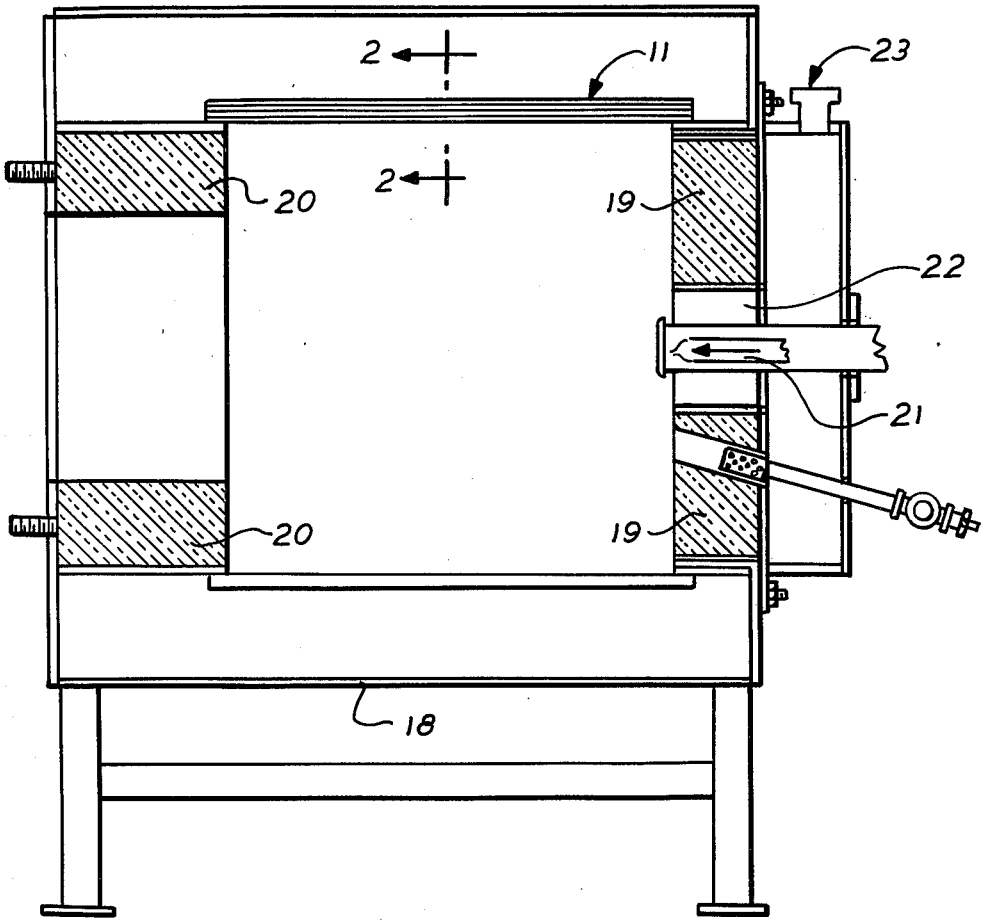
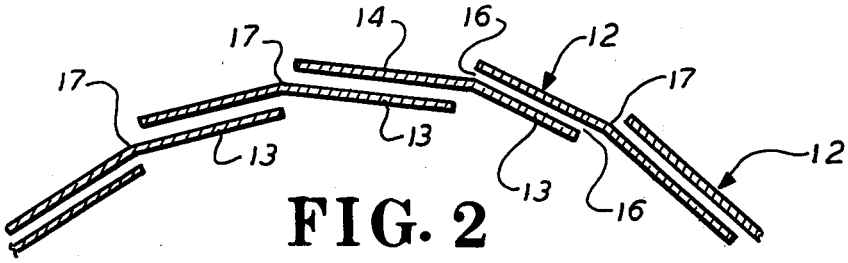
FIG. 2
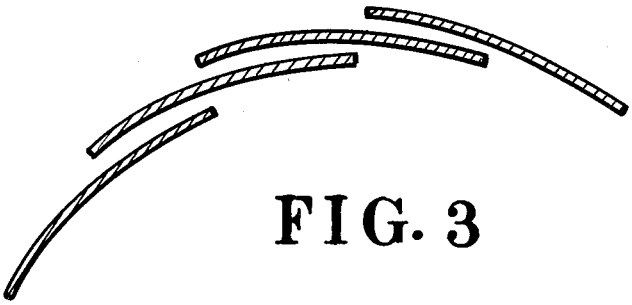
FIG. 3

TANGENT SPIN FURNACE

BACKGROUND OF THE INVENTION

1. FIELD OF THE INVENTION:

This invention relates generally to tangent spin furnaces and particularly to tangent spin furnaces in which a sweep of combustion air enters the combustion chamber between spaced slats and flows peripherally over the internal surface of the combustion chamber from the longitudinal slits, thereby eliminating the necessity for refractory material and keeping the combustion chamber walls at a relatively low temperature.

2. PRIOR ART:

Tangential spin furnaces are known and are used for accomplishing combustion of numerous materials. They are usually lined with refractory material to protect the metal of which the combustion chamber is usually made, otherwise the combustion chamber may be overheated and may rapidly deterioriate. To line a combustion chamber with refractory material or renew that refractory material when it has deteroriated, is expensive and time-consuming. It is therefore highly desirable to provide a combustion chamber which is highly resistant to deterioriation without the use of refractory material linings.

SUMMARY OF THE INVENTION

It has been found that an unlined combustion chamber without a lining of refractory material may be constructed of a plurality of slats defining a generally cylindrical combustion chamber. The slats are arranged in overlapping relationship to each other so that both the exterior surface of each slat and the interior surface of each slat in the combustion chamber is swept by air stream filaments of combustion air entering the combustion chamber; the peripheral sweep of the air stream filaments of combustion air dispense with the need for a lining of refractory material and keep the interior surface of the combustion chamber in a relatively cool state and resistant to thermal deterioration.

DRAWINGS

These objects and advantages as well as other objects and advantages may be attained by the device shown by way of illustration in the drawings in which:

FIG. 1 is a vertical sectional view of the tangent spin furnace;

FIG. 2 is a latitudinal partial, sectional view of the bent form of slats, showing the slots between them; and FIG. 3 is a latitudinal partial, sectional view of the combustion chamber with arcuate slats instead of bent slats.

PREFERRED EMBODIMENT

Referring now to the drawings in detail the tangient spin furnace provides a generally cylindrical combustion chamber 11, composed of a plurality of slats 12 arranged about the central axis of the combustion chamber 11. Each slat 12 is dimensionally divided longitudinally into an inside section 13 and outside section 14. At least a portion of each of the outside sections 14 of the slats 12 overlaps the inside section 13 of an underlying slat 12. At least a portion of each of the inside sections 13 of the slats 12 is overlapped by the outside section of the superposed slat 12.

The overlapped portions of the slats 12 are arranged in spaced relationship to each other to define longitudinal passages 16 for air stream filaments of combustion air to enter the combustion chamber 11. The passages 16 for air stream filaments are disposed to direct combustion air to peripherally traverse the inside of the combustion chamber over the inside sections 13 of the slats. The outside sections 14 of the slats 12 are also swept by air stream filaments entering into the passages 16.

Both sides of the slats 12 are thus swept by air stream filaments entering the combustion chamber and in this way a low temperature of the slats 12 defining the combustion chamber 11 is maintained, without the use of refractory material. The inside sections 13 and the outside sections of the slats 12 are defined by a longitudinal bend 17. This longitudinal bend 17 divides each slat into coequal inside 13 and outside 14 sections. The longitudinal bend 17 is not essential but serves to enhance the peripheral sweep of combustion air over the interior of the combustion 11 and to insure its relative coolness without the use of refractory material. It is noted that the slats 12 may be completely flat instead of having an inside section 13 and an outside section 14 disposed at a slight oblique angle to each other on opposite side of the longitudinal bend 17. The oblique angle at which the inside section 13 and the outside section 14 on either side of the longitudinal bend 17 are disclosed encourages peripheral sweeping of the interior of the combustion chamber 11. It is further noted that the slats 12 instead of having generally flat inside section 13 and outside section 14 may have an inside and outside section which is arcuate and as such see FIG. 3 will further enhance the peripheral sweep of air stream filaments over the internal surface of the combustion chamber to keep it cooler. It is preferred that the edge of a superposed slat 12 and the edge of an underlying slat 12 should be in general registration with the longitudinal bend 17 and slats 12. In this way each slat will be covered for approximately one-half of its extent on both top and bottom sides so that the air stream filaments will be maintained in intimate contact with the slat 12 for at least half of its extent on both top and bottom thereby insuring enhanced cooling.

In the present tangent spin furnace, a burner is arranged coaxially with the longitudinal axis of the generally cylindrical combustion chmaber 11. The combustion chamber is surrounded by a plenum 18 which delivers combustion air to the combustion chamber 11 through the spaces defined by the slats 12. It is noted that all of the passages 16 between the slats 12 are arranged in approximate tangential relationship to the combustion chamber 11 and in this manner insure a substantial interior peripheral sweep of cooling air stream filaments over the interior of the combustion chamber 11 to keep the temperature of the combustion chamber low.

The combustion chamber may have an entrance port composed of refractory material 19 and likewise a discharge port composed of refractory material 20. A burner 21 supplies combustion material such as oil or gas to the combustion chamber 11. The refractory material 19 is provided with a central orifice 22 to permit the introduction of solid or pulverized combustible materials to a pilot burner 21 through a tangent inlet 23. In addition, primary air may be introduced through the orifice 22 and also a mixture with the primary air of additional fuel is contemplated through the inlet 23.

By the foregoing construction, there is provided a tangent spin furnace having a combustion chamber of metal which operates a relatively low temperature without the use of a refractory material liner.

What is claimed:

1. A tangent spin furnace comprising, (a) a plurality of slats defining a generally cylindrical combustion chamber, (b) each slat having longitudinal inside and outside sections defined by a longitudinal bend, the planes of the inside and outside sections disposed at an oblique angle to each other on opposite sides of the longiutdinal bend, (c) at least a portion of each of the outside sections of the slats overlapping the inside sections of the underlying slats, (d) at least a portion each of the inside section of the slats overlapped by the outside sections of the superposed slats, (e) the overlapped portions of the slats arranged in spaced relation to each other to define longitudinal passages for air stream filaments of combustion air to enter the combustion chamber, (f) the passages for air stream filaments being positioned generally tangentially to the entire length of the interior of the combustion chamber to direct the combustion air to peripherally traverse the inside of the combustion chamber over the inside section of the slats, (g) the outside section of the slats being swept by the air stream filaments entering the passages, (h) a plenum surrounding the combustion chamber for supplying the air stream filaments of combustion air thereto, and (i) a burner disposed coaxially with the combustion chamber.

2. A tangent spin furnace according to claim 1 in which the inside and outside sections of the slats are flat.

3. A tangent spin furnace according to claim 1 in which the inside and outside sections of the slats are arcuate.

4. a tangent spin furnace according to claim 1 in which the overlapped outside and inside sections of the slats are in registration at their edges with the longitudinal bend.

* * * * *